US005228696A

United States Patent [19]

Gianferrara

[11] Patent Number: 5,228,696

[45] Date of Patent: Jul. 20, 1993

[54] GOLF PRACTICE TARGET

[76] Inventor: John Gianferrara, 23-B Queens Way, Camillus, N.Y. 13031

[21] Appl. No.: 910,537

[22] Filed: Jul. 8, 1992

[51] Int. Cl.[5] ..... A63B 69/36

[52] U.S. Cl. ..... 273/199 A; 273/187.3

[58] Field of Search ..... 273/199 R, 200 B, DIG. 30, 273/187.2, 187.1, 199 A, 200 A, 200 R, 200 C, 187.3

[56] References Cited

U.S. PATENT DOCUMENTS

| | | | |
|---|---|---|---|
| 3,518,786 | 7/1970 | Holtvoigt | 273/199 R |
| 5,026,064 | 6/1991 | Novosel | 273/DIG. 30 |
| 5,127,654 | 7/1992 | Thackrey | 273/200 B X |

FOREIGN PATENT DOCUMENTS

| | | | |
|---|---|---|---|
| 16231 | of 1910 | United Kingdom | 273/199 A |
| 383767 | 11/1932 | United Kingdom | 273/200 B |
| 930255 | 7/1963 | United Kingdom | 273/199 R |

*Primary Examiner*—George J. Marlo

*Attorney, Agent, or Firm*—Katherine McGuire

[57] ABSTRACT

A golf practice target comprising a body of homogeneous, resilient material having a first, annular surface extending between and lying perpendicular to second and third, opposite, planar striking surfaces which are struck with the hitting face of a golf club. The target includes a fourth, bottom planar surface for supporting the target upon any horizontal support surface. In alternate embodiments of the target, either a trapezoidal or rectangular neck integrally extends from the upper body portion to simulate a tee for long driving shots and the planar striking surfaces may be covered with flexible sheets of 2 mil polyethlene for providing increased durability. The target becomes airborne following a strike yet will not harm or knock over anything it may contact due to the low density material from which it is made. The target may therefore be used both indoors and outdoors in any area where there is sufficient clearance for a golf club swing.

4 Claims, 1 Drawing Sheet

GOLF PRACTICE TARGET

BACKGROUND OF THE INVENTION

This invention relates to the game of golf and, more particularly, to a novel and unique golf practice target which can be used both indoors and outdoors.

Golf practice targets are used by golfers to practice the various types of strokes used during an actual golf game (e.g., the "putt", "chip" and "drive"). Golfers typically practice long drive shots at the driving range since much space is required to practice such shots with an actual ball. For those who cannot travel to a driving range, a variety of golf practice targets made especially for practicing long driving strokes have developed over the years. The following U.S. patents disclose various types of such targets:

U.S. Pat. No. 1,881,991 issued to Yaggi on Oct. 11, 1932. The Yaggi target is in the shape of a flattened ball with a neck having a longitudinal slot for insertion into a base. The target is formed of a flexible sheet of rubber and when struck by a golf club, bends in the direction of the stroke and springs back to its upstanding position in the base thus allowing for repeated strikes without having to retrieve the target.

U.S. Pat. No. 1,733,767 issued to Yaggi on Oct. 29, 1927. This earlier Yaggi target is also formed of flexible rubber and is in the shape of a flattened ball with a neck to which is mounted a spike for insertion into soft earth. In one embodiment, a ball and socket joint is provided at the juncture of the spike and target neck which causes the target head to remain in the fallen position following a strike. The position of the fallen target indicates to the golfer whether the stroke was on or off-center.

U.S. Pat. No. 1,784,363 issued to Lester on Jul. 16, 1929. The Lester target also is in the shape of a flattened ball and is formed of rubber so as to be flexible. The target includes a neck with a circular base portion which is inserted into an annular channel in a separate stationary base which is mounted to a floor surface by suction. As with the '991 Yaggi device, the Lester target head springs back to its upright position following each strike with a golf club.

Lastly, U.S. Pat. No. 1,921,523 issued to Hart on Jan. 6, 1931 discloses a golf practice target comprising a light, spherical ball with a pair of leather strips connected thereto to form a tee. The leather strips are splayed apart to form a support when the ball is placed upon a planar surface in position for a strike, and to act as a drag when the ball is in flight.

SUMMARY OF THE INVENTION

It is a principle object of the present invention to provide a golf practice target which can be used in virtually any location including indoors as well as outdoors.

It is another object of the present invention to provide a golf practice target which may fly through the air when struck.

It is a further object of the present invention to provide a golf practice target which is so light in weight and density that it is incapable of destructively impacting with other objects no matter how much force is used when striking the target.

It is yet another object of the present invention to provide a golf practice target which is durable yet also extremely simple in design and construction and therefore very economically attractive.

Other objects will in part be obvious and in part appear hereinafter.

In accordance with the foregoing objects, the invention comprises a golf practice target formed of a lightweight resilient material such as polyurethane. The target is in the shape of a partial sphere having flattened poles and further includes (in some embodiments) an integrally formed tee or neck adapted to rest the target upon a surface in an upstanding position ready to be stricken in the usual manner of hitting a golf ball. When struck by a golf club, the target becomes airborne but cannot harm any object it happens to strike due to the low density and weight of the material from which it is made. The target may therefore be used indoors in places where there is only enough room to execute a full swing of a golf club without fear of damaging furnishings in the immediate area with the target. The target furthermore allows the golfer to observe the trajectory of its flight which is a valuable indicator of a successful swing. Also, an audible "cracking" sound is made by the club hitting face striking the target which is very similar to the sound of a golf ball being hit with a golf club.

DETAILED DESCRIPTION

Figure 1:
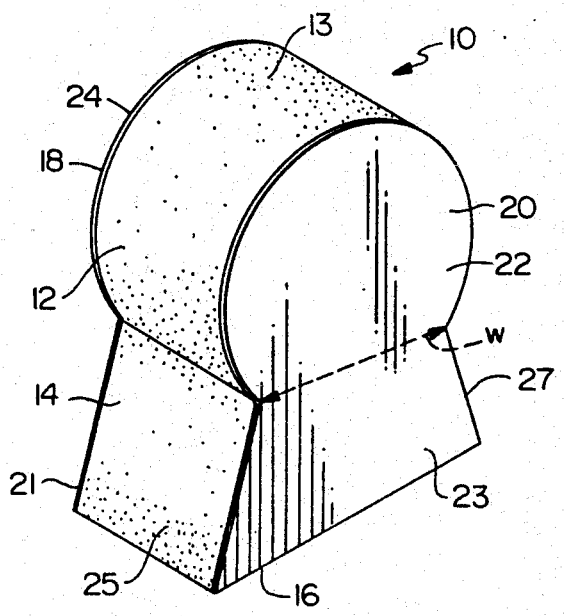
FIG. 1 is a perspective view of a first embodiment of the invention.

Referring now to the drawings, there is seen in FIG. 1 a first embodiment of the golf practice target indicated generally by the reference numeral 10. Target 10 is cut or otherwise formed entirely from a resilient material, preferably polyurethane, and is configured to have an upper rounded head portion 12 having a first annular surface 13 with second and third, opposite planar striking surfaces 18 and 20, with an outwardly tapering neck portion 14 integrally extending therefrom and terminating at a planar bottom surface 16. Although head portion 12 and neck portion 14 are integrally formed as one piece, they are divided in FIG. 1 by an imaginary dashed line for purposes of reference and to facilitate description thereof. Neck portion 14 includes fourth and fifth, opposite planar surfaces 21 and 23, respectively, which integrally extend from and lie coplanar with second and third striking surfaces 18 and 20, respectively, of head portion 12. First and second flexible sheets of 2 mil polyethylene 22 and 24 are adhered in complete covering relation to surfaces 18, 21 on one side of target 10, and to surfaces 20, 23 on the opposite side of target 10, respectively, giving target 10 increased durability and an audible "cracking" sound when struck by a golf club in the intended manner.

Since neck portion 14 tapers outwardly in a direction away from head portion 12, neck portion 14 includes sixth and seventh, opposite planar surfaces 25 and 27, respectively, which extend between and lie normal to fourth and fifth parallel surfaces 21 and 23. Although target 10 may be used to practice virtually any golf stroke, it is especially suited as a target when executing a long stroke with a driver. The golfer simply places bottom surface 16 on any surface (e.g., grass, driveway, carpet, tile, etc.) with neck 14 (serving as the "tee") supporting head 12 (serving as the "golf ball") above the ground as in a regular game of golf. The golfer swings at target 10 with either surface 18 or 20 facing in the direction of the golf club with the hitting face of the club striking surface 18 or 20, whichever one is facing the club. Target 10 will become airborne and land in close proximity to the golfer since target 10 is of such light density, no matter how much force is used when striking target 10. Target 10 will not damage or knock anything over it comes in contact with after being struck either which is why it is very desirable for use in the home or office. The golfer simply retrieves the target and positions it for another stroke as desired. If the golfer wishes to shorten the height of neck portion 14, target 10 may be easily cut with a knife or scissor to remove portions of neck 14 along a plane spaced and parallel to bottom surface 16.

Figure 2:
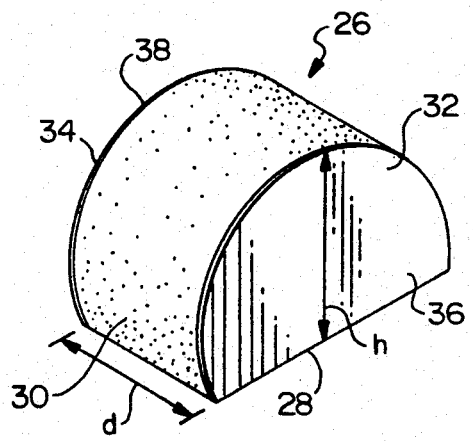
FIG. 2 is a perspective view of a second embodiment of the invention.

Referring to FIG. 2, a second embodiment of the invention is seen which is formed of the same materials as the target of FIG. 1 (polyurethane and polyethylene) and is different therefrom only in shape. Specifically, target 26 is seen to be in the shape of a half-circle with a planar bottom surface 28, annular top surface 30 and opposite, planar surface 32 and 34. Surfaces 32 and 34 are also covered with 2 mil polyethylene layers 36 and 38, respectively, for increased durability. Target 26 is for use by golfers desiring to practice short strokes such as the putt and chip shots, for example, which do not need the ball supported upon a tee. The golfer would thus set target 26 upon a floor or ground surface with bottom surface 28 contacting the ground and either planar surface 32 or 34 facing the club whereby the golfer swings to hit the planar surface with the hitting face of the club.

Figure 3:
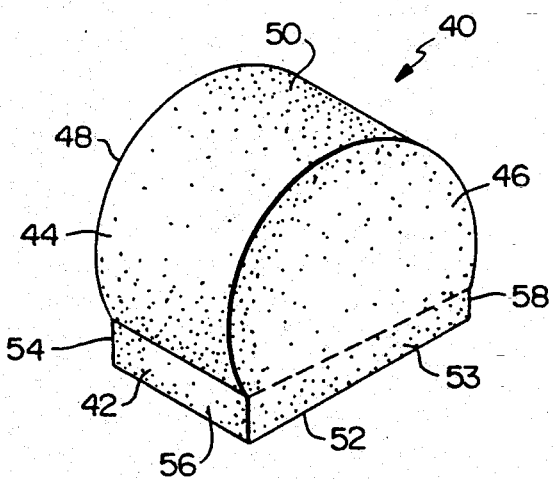
FIG. 3 is a perspective view of a third embodiment of the invention.

Referring lastly to FIG. 3, a third embodiment of the invention is shown referenced by numeral 40. Target 40 is the same as target 26 except that target 40 further includes a neck portion 42 extending downwardly from head portion 44 to provide a "tee" for head portion 44 which represents a golf ball. As with the embodiment of FIG. 1, head portion 44 and neck portion 42 are divided by an imaginary dashed line for purposes of description. Head portion 44 includes a first annular surface 50 extending between and lying normal to second and third striking surfaces 46 and 48, respectively, which lie in spaced, parallel planes to each other. Neck portion 42 also includes sixth and seventh opposite surfaces 56 and 58, respectively, which lie in spaced, parallel planes and perpendicular to fourth and fifth surfaces 53 and 54, respectively, and bottom surface 52.

This third embodiment is useful for short and medium length shots, or for the golfer who prefers a move elevated annular (or "head") portion than the embodiment of FIG. 2 provides, but less than the embodiment of FIG. 1. It will also be noticed that the embodiment of FIG. 3 does not include a polyethylene layer on either of its planar surfaces 46 and 48 as do the targets of FIGS. 1 and 2. This is to stress the fact that layers 22, 24 and 36, 38 are optional for those who desire the increased durability and sound the target makes with a golf club.

All targets 10, 26 and 40 are virtually indestructible and have useful lives which will probably outlast their owners. There is thus provided a novel and unique golf practice target which can be used anywhere there is sufficient room to swing a golf club and which is not fixed to the ground or a base unit such that the golfer can view the trajectory of the target after it is hit. The targets are further highly desirable to the indoor practice golfer since they create the same "cracking" sound as a golf ball does when struck by a golf club, and are virtually incapable of harming anything the targets may contact after being hit.

Although the invention has been shown and described with particular reference to preferred embodiments thereof, it will be apparent to those skilled in the art that various changes and modifications can be made thereto without departing from the full spirit and scope of the invention which is defined by the claims which follow.

What is claimed is:

1. A golf practice target for use on a horizontal, planar support surface comprising:

a) a head portion (12) having a first annular surface (13) integrally extending between second and third, planar striking surfaces (18 and 20), respectively, said second and third planar striking surfaces lying in spaced, parallel planes to each other and each having identical, annular outlines which are equal in diameter to the diameter of said first annular surface; and b) a neck portion (14) integrally extending from said head portion (12) to a bottom surface (16), said neck and head portions (12, 14) together formed of a continuous, homogeneous and resilient material, said neck portion (14) being substantially trapezoidal shaped and comprising:

i) fourth and fifth, opposite planar surfaces (21, 23), respectively, integrally extending from and lying co-planar with said second and third planar striking surfaces (18, 20), respectively, said fourth and fifth planar surfaces (21, 23) extending between said head portion and said bottom surface;

ii) sixth and seventh, opposite planar surfaces (25, 27) extending between and lying perpendicular to said fourth and fifth planar surfaces (21, 23), said sixth and seventh surfaces (25, 27) further extending and tapering outwardly from said head portion (12) to said bottom surface (16);

iii) said planar bottom surface (16) extending between and lying perpendicular to said second and third planar striking surfaces (18, 20) of said head portion (12), said bottom surface (16) having a surface area sufficient to support said head portion (12) vertically above said neck portion (14) when said bottom surface (16) is laid upon said horizontal, planar support surface.

2. The invention according to claim 1 wherein said practice target further includes first and second, flexible sheets adhered in covering relation to said second and fourth planar surfaces (18, 21), and said third and fifth planar surfaces (20, 23), respectively.

3. A golf practice target for use on a horizontal, planar support surface comprising:

a) a head portion (44) having a first, annular surface (50) extending between second and third, planar striking surfaces (46, 48), respectively, said second and third, planar striking surfaces lying in spaced, parallel planes to each other; and b) a neck portion (42) of substantially rectangular shape integrally extending from said head portion (44), said neck and head portions (42 and 44) together formed of a continuous, homogeneous and resilient material, said neck portion (42) including fourth and fifth, opposite surfaces (53, 54), respectively, lying in spaced, parallel planes to each other and extending coplanar from said second and third striking surfaces (46, 48), respectively, said neck portion (42) terminating into a substantially planar bottom surface (52) extending between and lying perpendicular to said second and third planar striking surfaces (46, 48), said neck portion (42) further including sixth and seventh, opposite planar surfaces (56, 58), respectively, extending between and lying perpendicular to said fourth and fifth planar surfaces (53, 54), said fourth and fifth opposite planar surfaces (53, 54), and said sixth and seventh opposite planar surfaces (56, 58) extending from said head portion (44) to said bottom surface (52), said planar bottom surface having a surface area sufficient to support said head portion vertically above said neck portion when said bottom surface is laid upon said horizontal, planar support surface.

4. The invention according to claim 3 wherein said practice target further includes first and second, flexible sheets adhered in covering relation to said second and fourth, and said third and fifth planar surfaces, respectively.

* * * * *